US009130355B2

(12) United States Patent
Kodama et al.

(10) Patent No.: US 9,130,355 B2
(45) Date of Patent: Sep. 8, 2015

(54) SPARK PLUG

(75) Inventors: Kazuhiro Kodama, Hekinan (JP); Hiroaki Nasu, Gifu (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 116 days.

(21) Appl. No.: 13/991,183

(22) PCT Filed: Sep. 6, 2011

(86) PCT No.: PCT/JP2011/004988

§ 371 (c)(1), (2), (4) Date: Jun. 3, 2013

(87) PCT Pub. No.: WO2012/077260

PCT Pub. Date: Jun. 14, 2012

(65) Prior Publication Data

US 2013/0249380 A1 Sep. 26, 2013

(30) Foreign Application Priority Data

Dec. 7, 2010 (JP) ..... 2010-272112

(51) Int. Cl.

| | |
|---|---|
| ***H01T 13/00*** | (2006.01) |
| ***H01T 13/06*** | (2006.01) |
| ***H01T 13/20*** | (2006.01) |
| ***H01T 13/39*** | (2006.01) |
| ***H01T 13/32*** | (2006.01) |

(52) U.S. Cl.

CPC ..... *H01T 13/06* (2013.01); *H01T 13/20* (2013.01); *H01T 13/32* (2013.01); *H01T 13/39* (2013.01)

(58) Field of Classification Search

USPC ..... 313/141, 140–142

See application file for complete search history.

(56) References Cited

U.S. PATENT DOCUMENTS

| | | | | |
|---|---|---|---|---|
| 6,768,249 | B1 | 7/2004 | Nasu et al. | 313/140 |
| 2003/0168955 | A1 | 9/2003 | Suzuki et al. | 313/143 |
| 2007/0216277 | A1 * | 9/2007 | Yoshida et al. | 313/141 |
| 2012/0052319 | A1 * | 3/2012 | Sugawara et al. | 428/613 |

FOREIGN PATENT DOCUMENTS

| | | | | |
|---|---|---|---|---|
| CN | 101039017 | A | 9/2007 | H01T 13/20 |
| EP | 1324446 | A2 | 7/2003 | H01T 13/36 |
| JP | 55050483 | | 4/1980 | C25D 3/12 |
| JP | 2002-184552 | | 6/2002 | F02P 13/00 |
| JP | 2005-285490 | | 10/2005 | H01T 13/02 |
| JP | 2010-185116 | A | 8/2010 | C25D 5/14 |

OTHER PUBLICATIONS

Form PCT/ISA/210—Int'l Search Report (from corresponding Int'l Patent App. No. PCT/JP2011/004988—1 page.

Office Action received in corresponding Chinese Patent Application No. 201180059085.5, dated May 13, 2014 (English-language translation provided).

* cited by examiner

*Primary Examiner* — Mariceli Santiago

*Assistant Examiner* — Brenitra M Lee

(74) *Attorney, Agent, or Firm* — Kusner & Jaffe

(57) ABSTRACT

To provide a technology of improving the corrosion resistance of a spark plug.

A spark plug having a metal shell on the outer surface of which a nickel plated layer is formed as a protective surface film. The nickel plated layer is such that when the atomic concentrations of constituent elements are measured in a depth direction by an X-ray photoelectron spectroscopy (XPS), the concentration of carbon atoms is 1.0% to 10.0% at a depth at which the atomic concentration of Ni elements is 80%.

8 Claims, 9 Drawing Sheets

FIG. 6

| SAMPLE NO. | S01 | S02 | S03 | S04 | S05 |
|---|---|---|---|---|---|
| C ATOM CONCENTRATION [%] | 0.0 | 1.0 | 5.0 | 10.0 | 20.0 |
| CORROSION RESISTANCE EVALUATION | × | ● | ● | ● | × |
| PRIMARY BRIGHTENING AGENT SACCHARIN [g/L] | 0.0 | 0.1 | 0.4 | 0.8 | 1.6 |
| SECONDARY BRIGHTENING AGENT 2-BUTYNE-1,4-DIOL [g/L] | 0.0 | 0.4 | 0.5 | 0.6 | 0.8 |

CORROSION RESISTANCE EVALUATION CRITERIA

◇ : NO OCCURRENCE OF RED RUST

○ : OCCURRENCE OF RED RUST 5% OR LESS

● : OCCURRENCE OF RED RUST MORE THAN 5% AND 10% OR LESS

× : OCCURRENCE OF RED RUST MORE THAN 10%

FIG. 7

| SAMPLE NO. | S03 | S06 | S07 | S08 | S09 | S10 | S11 | S12 | S13 |
|---|---|---|---|---|---|---|---|---|---|
| P ATOM CONCENTRATION [%] | 0.0 | 0.1 | 5.0 | 10.0 | 20.0 | 0.0 | 0.0 | 0.0 | 0.0 |
| B ATOM CONCENTRATION [%] | 0.0 | 0.0 | 0.0 | 0.0 | 0.0 | 0.1 | 5.0 | 10.0 | 20.0 |
| CORROSION RESISTANCE EVALUATION | ● | ◇ | ◇ | ◇ | × | ◇ | ◇ | ◇ | × |
| SODIUM HYPOPHOSPHITE | 0.0 | 1.0 | 20.0 | 40.0 | 80.0 | 0.0 | 0.0 | 0.0 | 0.0 |
| DMAB [g/L] | 0.0 | 0.0 | 0.0 | 0.0 | 0.0 | 0.1 | 2.5 | 5.0 | 10.0 |

CORROSION RESISTANCE EVALUATION CRITERIA

◇ : NO OCCURRENCE OF RED RUST

○ : OCCURRENCE OF RED RUST 5% OR LESS

● : OCCURRENCE OF RED RUST MORE THAN 5% AND 10% OR LESS

× : OCCURRENCE OF RED RUST MORE THAN 10%

FIG. 8

| | | | TREATING TIME [MIN] | 90 | 85 | 80 | 75 | 70 | 65 | 60 | 55 | 50 | 40 | 30 |
|---|---|---|---|---|---|---|---|---|---|---|---|---|---|---|
| | | | CURRENT DENSITY [A/D m$^2$] | 0.22 | 0.24 | 0.25 | 0.27 | 0.29 | 0.31 | 0.33 | 0.36 | 0.40 | 0.50 | 0.67 |
| | | | MINIMUM VALUE OF THICKNESS OF NI PLATED LAYER [$\mu$M] | 2.8 | 2.5 | 2.3 | 2.0 | 1.5 | 1.0 | 0.5 | 0.3 | 0.2 | 0.1 | 0.05 |
| SAMPLE NO. | S100 ~ S110 | TYPE A | Ni | × | × | × | ○ | ○ | ○ | ○ | ○ | × | × | × |
| | S200 ~ S210 | TYPE B | Ni + ELECTROLYTIC TRIVALENT CHROMATE | × | × | ○ | ○ | ○ | ○ | ○ | ○ | ○ | × | × |
| | S300 ~ S310 | TYPE C | Ni + ANTI-RUST OIL | × | × | ○ | ○ | ○ | ○ | ○ | ○ | ○ | × | × |
| | S400 ~ S410 | TYPE D | Ni + ELECTROLYTIC TRIVALENT CHROMATE +ANTI-RUST OIL | × | ○ | ○ | ○ | ◇ | ◇ | ◇ | ◇ | ○ | ○ | × |

CORROSION RESISTANCE EVALUATION CRITERIA

◇ : NO OCCURRENCE OF RED RUST

○ : OCCURRENCE OF RED RUST 5% OR LESS

● : OCCURRENCE OF RED RUST MORE THAN 5% AND 10% OR LESS

× : OCCURRENCE OF RED RUST MORE THAN 10%

FIG. 9

| | | | TREATING TIME [MIN] | 90 | 85 | 80 | 75 | 70 | 65 | 60 | 50 | 45 | 40 | 30 |
|---|---|---|---|---|---|---|---|---|---|---|---|---|---|---|
| | | | CURRENT DENSITY [A/D m$^2$] | 0.22 | 0.24 | 0.25 | 0.27 | 0.29 | 0.31 | 0.33 | 0.40 | 0.44 | 0.50 | 0.67 |
| | | | MAXIMUM VALUE − MINIMUM VALUE [μm] | 1.5 | 2.0 | 2.5 | 3.5 | 4.0 | 4.5 | 5.0 | 5.5 | 6.0 | 6.5 | 7.00 |
| SAMPLE NO. | S100 ~ S110 | TYPE A | Ni | ○ | ○ | ○ | ○ | ○ | ○ | ○ | ○ | × | × | × |
| | S200 ~ S210 | TYPE B | Ni + ELECTROLYTIC TRIVALENT CHROMATE | ○ | ○ | ○ | ○ | ○ | ○ | ○ | ○ | ○ | × | × |
| | S300 ~ S310 | TYPE C | Ni + ANTI-RUST OIL | ○ | ○ | ○ | ○ | ○ | ○ | ○ | ○ | ○ | × | × |
| | S400 ~ S410 | TYPE D | Ni + ELECTROLYTIC TRIVALENT CHROMATE + ANTI-RUST OIL | ○ | ○ | ○ | ○ | ◇ | ◇ | ◇ | ◇ | ◇ | ○ | × |

CORROSION RESISTANCE EVALUATION CRITERIA

◇ : NO OCCURRENCE OF RED RUST

○ : OCCURRENCE OF RED RUST 5% OR LESS

● : OCCURRENCE OF RED RUST MORE THAN 5% AND 10% OR LESS

× : OCCURRENCE OF RED RUST MORE THAN 10%

SPARK PLUG

FIELD OF THE INVENTION

The present invention relates to a spark plug.

BACKGROUND OF THE INVENTION

A spark plug used for an ignition of an internal combustion engine, such as a gasoline engine, includes a shaft-like center electrode, a cylindrical insulator which holds the center electrode on the inner side thereof, and a metal shell which holds the insulator on the inner side thereof. A substantially L-shaped ground electrode is provided on the metal shell so as to form a spark discharge gap between the ground electrode and center electrode. The metal shell and ground electrode are generally configured from an iron-based material, such as carbon steel, and the outer surface thereof is subjected to a plating treatment for corrosion protection (See Japanese Document No. JP-A-2002-184552).

However, the metal shell has regions, such as an inner wall surface of a cylindrical hole in which is held the insulator and concave portions of the outer surface, through which it is difficult for an electric current to flow in a plating bath, and there is a possibility that the thickness of a plated layer to be formed becomes non-uniformity. When the thickness of the plated layer is non-uniform, it may happen that a stress concentration occurs in a region of the plated layer comparatively small in thickness in a process of crimping the metal shell, or the like, thus accelerating a peeling off of the plated layer. It is an actual situation that no sufficient ingenuity has been exercised so far in suppressing a peeling off of the plated layer by making the thickness of the plated layer uniform, and improving the corrosion resistance of the spark plug.

SUMMARY OF INVENTION

The invention has an object of providing a technology of improving the corrosion resistance of a spark plug.

The invention, having been contrived in order to solve at least one portion of the heretofore described problem, can be realized as the following aspects or application examples.

The invention can be realized in various forms, and can be realized in a form of, for example, a fuel cell, a fuel cell system including the fuel cell, a vehicle in which is mounted the fuel cell system, or the like.

APPLICATION EXAMPLE 1

A spark plug including a metal shell whose outer surface is coated with a nickel plated layer is characterized in that the nickel plated layer is such that when the atomic concentrations of constituent elements are measured in a depth direction by an X-ray photoelectron spectroscopy (XPS), the atomic concentration of C elements is 1.0% or more and 10.0% or less at a depth at which the atomic concentration of Ni elements is 80%.

APPLICATION EXAMPLE 2

In the spark plug according to application example 1, the nickel plated layer is such that the minimum value of the thickness is 0.3 μm or more and 2.0 μm or less, and the maximum value of the thickness is 15 μm or less.

APPLICATION EXAMPLE 3

In the spark plug according to application example 2, the nickel plated layer is such that the difference between the maximum value of the thickness and the minimum value of the thickness is 5.5 μm or less.

APPLICATION EXAMPLE 4

In the spark plug according to application example 1, a chromate layer or an rust prevention oil layer is formed on the nickel plated layer, and the nickel plated layer is such that the minimum value of the thickness is 0.2 μm or more and 2.3 μm or less, and the maximum value of the thickness is 15 μm or less.

APPLICATION EXAMPLE 5

In the spark plug according to application example 4, the nickel plated layer is such that the difference between the maximum value of the thickness and the minimum value of the thickness is 6.0 μm or less.

APPLICATION EXAMPLE 6

In the spark plug according to application example 1, a chromate layer is formed on the nickel plated layer, and an rust prevention oil layer is formed on the chromate layer, wherein the nickel plated layer is such that the minimum value of the thickness is 0.1 μm or more and 2.5 μm or less, and the maximum value of the thickness is 15 μm or less.

APPLICATION EXAMPLE 7

In the spark plug according to application example 6, the nickel plated layer is such that the difference between the maximum value of the thickness and the minimum value of the thickness is 6.5 μm or less.

APPLICATION EXAMPLE 8

In the spark plug according to any one of application examples 1 to 7, the nickel plated layer is such that when the atomic concentrations of constituent elements are measured in the depth direction by the X-ray photoelectron spectroscopy (XPS), the sum of the atomic concentration of P elements and the atomic concentration of B elements is 1.0% or more and 10% or less at the depth at which the atomic concentration of Ni elements is 80%.

According to the spark plug of application example 1, as the nickel plated layer is formed in an electrolytic nickel plating treatment on the metal shell so that the thickness of the nickel plated layer is made uniform, corrosion resistance is improved.

According to the spark plug of application example 2, as the thickness of the nickel plated layer is also secured in a kind of region through which it is difficult for an electric current to flow in the electrolytic nickel plating treatment on the metal shell, a decrease in corrosion resistance is suppressed.

According to the spark plug of application example 3, as the non-uniformity in thickness of the nickel plated layer on the metal shell is low, a decrease in corrosion resistance is suppressed.

According to the spark plug of application example 4, as a chromate layer or an rust prevention oil layer is formed on the nickel plated layer on the metal shell, corrosion resistance is more improved. Also, as the thickness of the nickel plated layer is also secured in a kind of region through which it is difficult for an electric current to flow in the electrolytic nickel plating treatment on the metal shell, a decrease in corrosion resistance is suppressed.

According to the spark plug of application example 5, as the non-uniformity in thickness of the nickel plated layer on the metal shell is low, a decrease in corrosion resistance is suppressed.

According to the spark plug of application example 6, as a chromate layer and an rust prevention oil layer are formed on the nickel plated layer on the metal shell, corrosion resistance is more improved. Also, as the thickness of the nickel plated layer is also secured in a kind of region through which it is difficult for an electric current to flow in the electrolytic nickel plating treatment on the metal shell, a decrease in corrosion resistance is suppressed.

According to the spark plug of application example 7, as the non-uniformity in thickness of the nickel plated layer on the metal shell is low, a decrease in corrosion resistance is suppressed.

According to the spark plug of application example 8, as the nickel plated layer is formed in the electrolytic nickel plating treatment on the metal shell so that the thickness of the nickel plated layer is made more uniform, corrosion resistance is improved.

BRIEF DESCRIPTION OF THE DRAWINGS

FIG. 6 is an illustration showing measured values of carbon atom concentrations in nickel plated layers, and corrosion resistance evaluation results, of five kinds of metal shell sample.

FIG. 7 is an illustration showing measured values of phosphorus atom and boron atom concentrations in nickel plated layers, and corrosion resistance evaluation results, of five kinds of metal shell sample.

FIG. 8 is an illustration showing corrosion resistance evaluation results of samples with nickel plated layer thickness minimum values varied from one another.

FIG. 9 is an illustration showing a difference between the maximum value and minimum value of the thickness of a nickel plated layer, and a corrosion resistance evaluation result, of each sample.

DETAILED DESCRIPTION OF PREFERRED EMBODIMENTS

Hereafter, firstly, a description will be given of an example of a structure of a spark plug and one portion of a process of manufacturing the spark plug.

Figure 1:
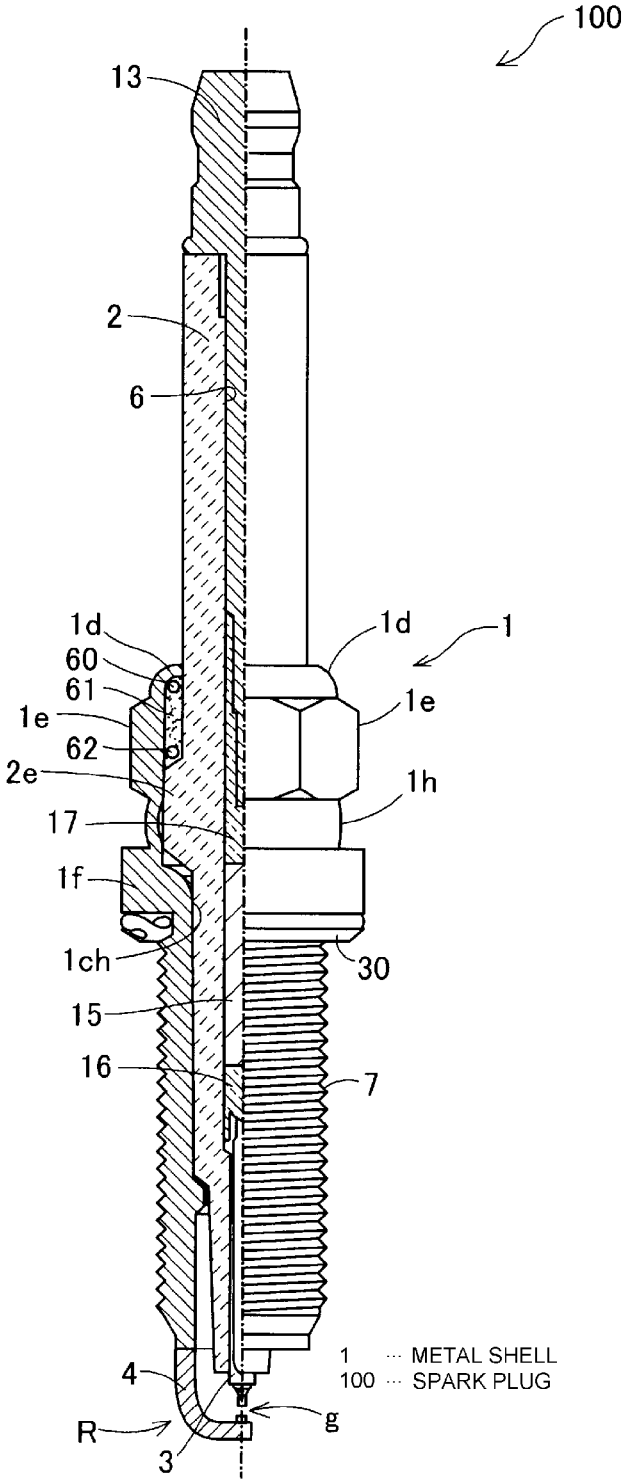
FIG. 1 is a main portion sectional view showing one example of a structure of a spark plug.

FIG. 1 is a main portion sectional view showing one example of a structure of a spark plug. The spark plug 100 includes a cylindrical metal shell 1, a cylindrical insulator 2 fitted in a cylindrical hole 1*ch* of the metal shell 1 so that a leading end portion of the insulator 2 protrudes, and a center electrode 3 provided on the inner side of the insulator 2 in a condition in which a leading end portion of the center electrode 3 is protruded. A ground electrode 4 is joined to the metal shell 1. The ground electrode 4 is disposed so that one end is joined to the metal shell 1 and the other end is opposite the leading end of the center electrode 3, and a spark discharge gap g is formed between the ground electrode 4 and center electrode 3.

The insulator 2 is configured of a ceramic sintered compact of, for example, alumina or aluminum nitride, and a through hole 6 into which to fit the center electrode 3 and a terminal metal fixture 13 is formed inside the insulator 2 in an axial direction of the insulator 2. The center electrode 3 is fixed in a leading end side (a lower side on the plane of FIG. 1) of the through hole 6, and the terminal metal fixture 13 is fixed in a rear end side (an upper side on the plane of FIG. 1) of the through hole 6. Also, a resistor 15 is disposed between the terminal metal fixture 13 and center electrode 3 in the through hole 6. The two end portions of the resistor 15 are electrically connected one each to the center electrode 3 and terminal metal fixture 13 via respective conductive glass seal layers 16 and 17.

The metal shell 1 is formed in a hollow cylindrical shape from a metal, such as carbon steel, thus configuring a housing of the spark plug 100. A thread portion 7 for mounting the spark plug 100 in a combustion chamber (not shown) of an internal combustion engine is formed on a leading end side (a lower side on the plane of FIG. 1) outer peripheral surface of the metal shell 1. A thread groove coming into threaded engagement with a thread hole for mounting the spark plug provided in the combustion chamber is cut in the thread portion 7. A hexagon portion 1*e* is provided on the rear end side of the thread portion 7. The hexagon portion le is a tool engagement portion with which a tool, such as a spanner or wrench, is brought into engagement when mounting the metal shell 1 in the combustion chamber, and has a hexagonal shape in cross-section.

A filling layer 61 filled with powder, such as talc, is formed between a inner wall surface of a rear end side opening portion of the metal shell 1 and an outer wall surface of the insulator 2. The filling layer 61 is formed between a flanged protruding portion 2*e* of the insulator 2 and a crimped portion 1*d* wherein an end portion of the opening portion of the metal shell 1 is crimped inward. Ring-shaped wire packings 62 and 60 are disposed respectively in the protruding portion 2*e* side end portion and crimped portion 1*d* side end portion of the filling layer 61.

A flanged gas seal portion 1*f* is provided between the hexagon portion 1*e* and thread portion 7 of the metal shell 1, and a gasket 30 is fitted on the thread portion 7 side of the gas seal portion 1*f*. The gasket 30 is a ring-shaped part wherein a metal plate material of carbon steel or the like is bent, and by the thread portion 7 being screwed into a cylinder head side thread hole, changes in shape so as to be compressed in the axial direction and crushed between the gas seal portion 1*f* and the opening edge portion of the thread hole, thus playing the role of sealing a gap between the thread hole and thread portion 7. A groove portion 1*h* is formed between the gas seal portion 1*f* and hexagon portion 1*e*. The groove portion 1*h* is formed so as to be the smallest in thickness in the metal shell 1, and is slightly curved outward. Hereafter, in this description, the groove portion 1*h* is also called a "thin-walled portion 1*h*".

FIGS. 4(A) to (D) are illustrations showing in order of steps one example of a process of manufacturing the metal shell 1. In the step of FIG. 2(A), a base material 1*a* of the metal shell 1 to which is joined the ground electrode 4 is prepared. The base material 1*a* is substantially the same as the metal shell 1 described in FIG. 1, except that a portion to be crimped 1*da* which is to become the crimped portion 1*d* is formed as a wall portion extending toward the rear end side, and that the thin-walled portion 1*h* is not curved, and the ground electrode 4 is also not bent and remains in a linear shape. The surface of the base material 1*a* is in a condition already subjected to a plating treatment for corrosion protection.

Next, in the step of FIG. 2(B), the insulator 2 is inserted into the through hole of the base material 1*a* from a rear end side insertion opening portion 1*p* of the base material 1*a*, and engagement portions 2*h* and 1*c* provided on the insulator 2 and base material 1*a* respectively are brought into engagement with each other via a plate packing 63. The center electrode 3, conductive glass seal layers 16 and 17, resistor 15, and terminal metal fixture 13 are mounted in advance in the insulator 2.

In the step of FIG. 2(C), the wire packing 62 is disposed from the insertion opening portion 1*p* of the base material 1*a*, after which the filling layer 61 of talc or the like is formed, and furthermore, the wire packing 60 is disposed on the insertion opening portion 1*p* side. Further, the portion to be crimped 1*da* is crimped by a crimping die 111, via the wire packing 62, filling layer 61, and wire packing 60, with an end surface 2*n* of the protruding portion 2*e* as a crimping support portion. By so doing, the portion to be crimped 1*da* changes in shape, thus forming the crimped portion 1*d*, as shown in FIG. 2(D), and the base material 1*a* is fixed by crimping to the insulator 2. The thin-walled portion 1*h* is curved by compression stress when crimping. After the crimping step, the ground electrode 4 is bent toward the center electrode 3 side to form a bend portion R, thereby forming the spark discharge gap g, and the spark plug 100 of FIG. 1 is completed.

In this way, in the steps after the plating treatment has been performed, the crimped portion 1*d*, the bend portion R of the ground electrode 4, thin-walled portion 1*h*, and the like, of the metal shell 1, are changed in shape by being subjected to an external force. Consequently, residual stress is generated in the crimped portion 1*d*, bend portion R of ground electrode 4, and thin-walled portion 1*h*, and a peeling off of a plated layer is likely to occur. Also, on the inner wall surface of the cylindrical hole 1*ch*, an uneven region of the outer surface, and the like, of the metal shell 1, it may happen that the thickness of the plated layer becomes non-uniform, and that the peeling off of the plated layer is accelerated due to an occurrence of stress concentration in a region of the plated layer small in thickness. When a peeling off of the plated layer occurs, the corrosion resistance of the metal shell 1 decreases.

Figure 3:
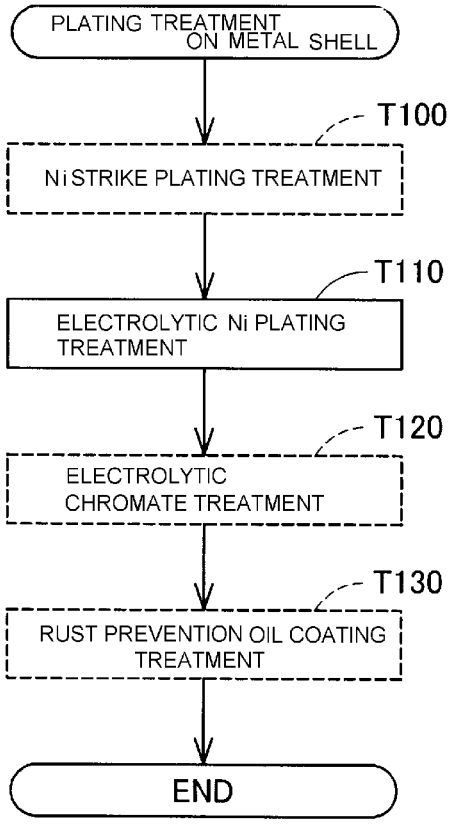
FIG. 3 is a flowchart showing a procedure of a plating treatment on the metal shell.

Therefore, in the embodiment, a corrosion protection treatment, such as a plating treatment, is performed on the outer surface of the base material 1*a* of the metal shell 1 before the crimping step which fixes the metal shell 1 and insulator 2. FIG. 3 is a flowchart showing a procedure of a corrosion protection treatment carried out on the base material 1*a* of the metal shell 1. In FIG. 3, steps which can be omitted are shown by the broken lines. Hereafter, a description will be given of treatment steps, steps T100 to T130, shown in FIG. 3.

A. Nickel Strike Plating Treatment (Step T100 of FIG. 3):

A nickel strike plating treatment is a treatment carried out in order to clean the surface of the base material 1*a* formed from carbon steel and improve the adhesion of a plated layer to an underlaying metal. However, the nickel strike plating treatment may be omitted. The nickel strike plating treatment can be carried out under normally utilized treatment conditions. Specific examples of preferable treatment conditions are as follows.

Examples of Nickel Strike Plating Treatment Conditions

Plating bath compositions

Nickel chloride: 150 to 600 g/L

35% hydrochloric acid: 50 to 300ml/L

Solvent: deionized water

Treatment temperature (bath temperature): 25 to 40° C.

Cathode current density: 0.2 to 0.4A/dm$^2$

Treating time: 5 to 20 minutes

B. Electrolytic Nickel Plating Treatment (Step T110 of FIG. 3)

As an electrolytic nickel plating treatment, it is possible to utilize a barrel type electrolytic nickel plating treatment using a rotating barrel. Another plating method, such as a still plating treatment, may be utilized as the electrolytic nickel plating treatment. The electrolytic nickel plating treatment can be carried out under normally utilized treatment conditions. Specific examples of preferable treatment conditions are as follows.

Examples of Electrolytic Nickel Plating Treatment Conditions

Plating bath compositions

Nickel sulfate: 100 to 400 g/L

Nickel chloride: 30 to 70 g/L

Boric acid: 20 to 60 g/L

Solvent: deionized water

Bath pH: 2.0 to 4.8

Treatment temperature (bath temperature): 25 to 60° C.

Cathode current density: 0.2 to 0.6A/dm$^2$

Treating time: 30 to 90 minutes

Herein, the inventors of the invention have found that it is possible, in the electrolytic nickel plating treatment, to promote the uniformity in thickness of a nickel plated layer by adjusting the plating bath compositions in the ways to be described hereafter. Also, the inventors of the invention have found that it is possible to suppress a decrease in corrosion resistance of the nickel plated layer by specifying the minimum value of the thickness of a nickel plated layer, which is formed using this kind of plating bath, and a preferred range of a difference between the maximum value and minimum value of the thickness. Hereafter, the plating bath compositions and nickel plated layer thickness in the electrolytic nickel plating treatment will each be described in order.

I. Regarding Plating Bath Compositions:

It is preferable, in the electrolytic nickel plating treatment, that a predetermined amount of carbon atoms is contained in a plating bath in order to improve corrosion resistance by achieving the uniformity in thickness of a nickel plated layer to be formed. Reasons for this will be described hereafter.

Figure 4:
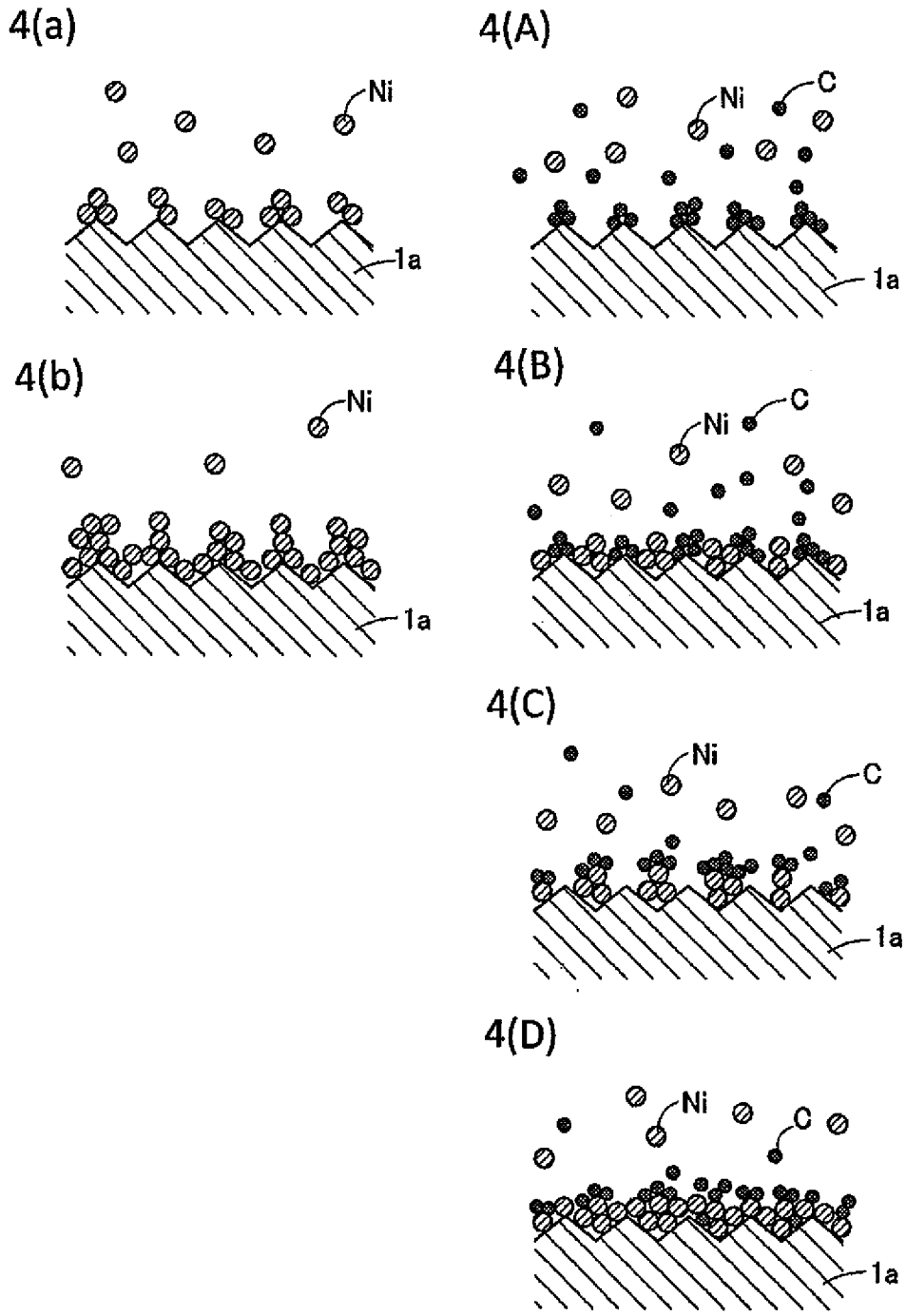
FIGS. 4(*a*), 4(*b*) and 4(A)-4(D) are schematic diagrams showing step by step how a nickel plated layer is formed on the outer surface of a base material in a plating bath.

FIGS. 4(*a*) and 4(*b*) are schematic diagrams showing step by step how a nickel plated layer is formed on the outer surface of the base material 1*a* in a plating bath in which no carbon atom is contained, as a comparison example. In FIGS. 4(*a*) and 4(*b*), the outer surface of the base material 1*a* and nickel atoms Ni in the plating bath are illustrated, while the illustration of other atoms is omitted.

In the nickel plating treatment, nickel atoms Ni in an ionic state in the plating bath tend to adhere preferentially to regions, such as convex portions existing on the surface of the base material 1*a*, through which it is easy for an electric current to flow (FIG. 4(*a*)). Consequently, normally, when the surface of the base material 1*a* has an unevenness, the thickness of the nickel plated layer becomes larger in the convex portions of the surface of the base material 1*a*, and smaller in the concave portions, thus resulting in non-uniformity in thickness, and smoothness is likely to decrease (FIG. 4(*b*)). However, when the predetermined amount of carbon atoms is contained in a plating bath, the non-uniformity in thickness of the plated layer is suppressed in the following way.

FIGS. 4(A) to 4(D) are schematic diagrams showing step by step how a nickel plated layer is formed on the outer surface of the base material 1*a* in the plating bath in which the predetermined amount of carbon atoms is contained. When a certain amount or more of carbon atoms C is contained in a plating bath, carbon atoms C adhere to the convex portions of the outer surface of the base material 1*a* in preference to nickel atoms Ni (FIG. 4(A)). Because of this, nickel atoms Ni adhere to the concave portions to which no carbon atom C has adhered, thus starting to form nickel plated layers (FIG. 4(B)).

When the nickel plated layers formed in the concave portions of the surface of the base material 1*a* start to protrude beyond the convex portions of the surface of the base material 1*a*, carbon atoms C move and adhere to the protruding nickel plated layer surfaces (FIG. 4(C)). Further, next, nickel atoms Ni adhere to regions to which a decreasing amount of carbon atoms C has adhered, thus starting to form a nickel plated layer (FIG. 4(D)).

Subsequently, the nickel plated layer is formed while the heretofore described kind of adhesion and separation of carbon atoms C is being repeated on the surface of the base material 1*a*. In this way, by carbon atoms C being contained in the plating bath, nickel atoms Ni are prevented from adhering disproportionately to the convex portions of the base material 1*a*. Because of this, the uniformity in thickness of the nickel plated layer is promoted, and the smoothness of the surface of the nickel plated layer is promoted.

Meanwhile, in general, the lower an impurity content, the more preferable a nickel plated layer. However, an amount of carbon atoms corresponding to the carbon atom content of the plating bath remains in a nickel plated layer formed in a plating bath in which carbon atoms are contained in the way heretofore described. The inventors of the invention have found that when the carbon atom concentration in a nickel plated layer is within a range of 1% to 10%, it is possible to suppress a decrease in corrosion resistance due to a mixing in of carbon atoms while making the thickness of the nickel plated layer uniform.

That is, when the carbon atom concentration in a nickel plated layer is 1% or more, it means that an amount of carbon atoms enough for the thickness of the nickel plated layer to be made uniform is contained in a plating bath for a electrolytic nickel plating treatment in which the nickel plated layer has been formed. Also, when the carbon atom concentration in a nickel plated layer exceeds 10%, the nickel plated layer becomes more likely to peel off due to carbon atoms mixed in the nickel plated layer, and corrosion resistance decreases.

Herein, in the description, the carbon atom concentration in a nickel plated layer is a value measured by an X-ray photoelectron spectrometer (XPS), and an atomic concentration in a position at a depth at which the nickel atom concentration is 80% or more. It is for the following reasons that the carbon atom concentration at this depth is made a reference.

Figure 5:
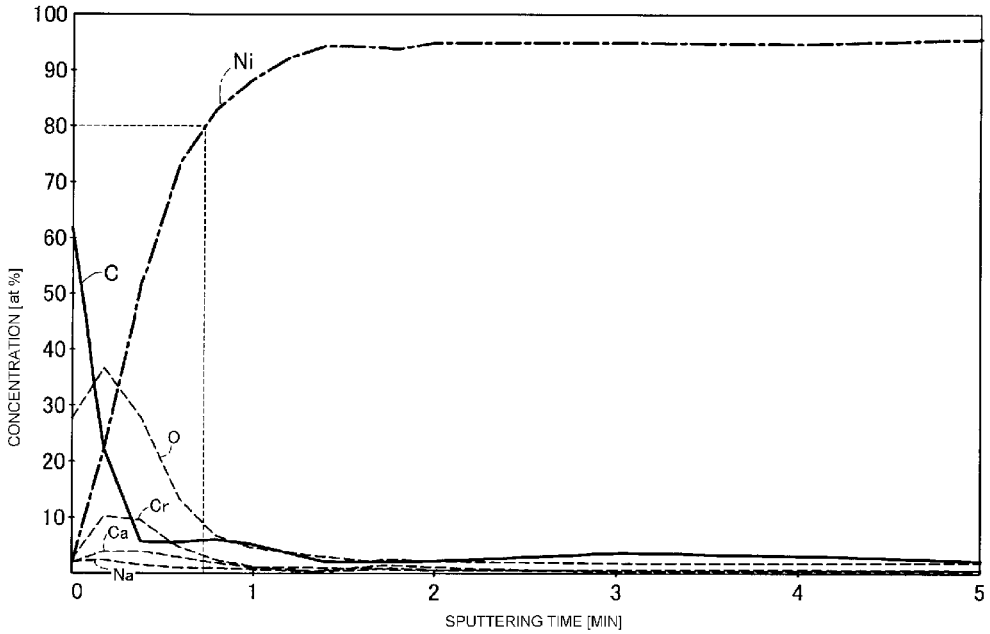
FIG. 5 is an illustration showing one example of a distribution of concentration of each element, in a thickness direction of the nickel plated layer, measured using an XPS.

FIG. 5 is a graph showing one example of a concentration distribution of each element, in a thickness direction of a nickel plated layer, measured using the XPS. In the graph, the vertical axis shows an atomic concentration (at%), and the horizontal axis shows a sputtering time (minutes). In the example shown in the graph, nickel (Ni), carbon (C), oxygen (O), chromium (Cr), calcium (Ca), and sodium (Na) are contained in the nickel plated layer. In FIG. 5, for the sake of simplicity, the graph of nickel is shown by the alternate long and short dash line, the graph of carbon is shown by the solid line, and the graphs of other atoms are shown by the dashed line.

It is in a region with a short sputtering time and in a comparatively superficial region of the nickel plated layer that the atomic concentration of nickel is less than 80%. In the superficial region, it may happen that the atomic concentration of carbon is detected to be of a significantly high value. This is because dirt or the like adhering to a superficial layer of the nickel plated layer is possibly detected. That is, it is difficult to accurately measure the atomic concentration of carbon in a region at a depth at which the atomic concentration of nickel is less than 80%.

Also, in general, the corrosion resistance function of a nickel plated layer is taken on mainly by a region at a depth at which the atomic concentration of nickel is 80% or more. Consequently, when carrying out an evaluation of the nickel plated layer, it is preferable to carry it out in a region deeper than at the depth. For these reasons, it is desirable that a measurement of the atomic concentration of carbon in the nickel plated layer is carried out at a depth, at which the atomic concentration of nickel is 80% or more, away from a superficial region of the nickel plated layer.

Meanwhile, in the electrolytic nickel plating treatment, brightening agents are added to a plating bath in order to improve the smoothness of a nickel plated layer. Further, when adding the brightening agents, a primary brightening agent for adjusting the hardness of the plated layer and a secondary brightening agent taking on a brightening effect are used in combination. Specifically, the following compounds are used as the brightening agents.

Examples of Primary Brightening Agent

Organic compounds including in the molecules the structure of "═C—$SO_2$—":

Various kinds of sulfonate such as sodium 1,3,6-naphthalenetrisulfonate and sodium 1,5-naphthalenedisulfonate/sulfonimide (for example, saccharin)/sulfonamide (for example, para toluene sulfonamide)/sulfinic acid, and the like.

Examples of Secondary Brightening Agent

Organic compounds including in the molecules the structure of at least one of "C═O", "C═C", "C≡C", "C═N", "C≡N", "N—C═S", "N═N", or "—$CH_2$—CH—O—":

Coumalin/2-butyne-1,4-diol/ethylene cyanohydrin/propargyl alcohol/formaldehyde/thiourea/quinoline/pyridine, and the like.

In this way, carbon atoms are contained as a major component in the brightening agents. Because of this, by using these brightening agents, it is possible to cause carbon atoms to be contained in a plating bath. That is, by adjusting the amounts of brightening agents added to the plating bath, it is possible to promote the uniformity in thickness of a nickel plated layer to be formed. Specifically, the following amounts of brightening agents may be added to the plating bath.

Examples of Amounts of Brightening Agents Added to Plating Bath in Electrolytic Nickel Plating Treatment Primary brightening agent: 0.01 to 1.5 g/L Secondary brightening agent: 0.3 to 0.7 g/L Furthermore, the inventors of the invention have found that, by causing a predetermined amount of phosphorus atoms (P) and/or boron atoms (B) to be contained in a plating bath in which carbon atoms are contained, it is possible to further promote the uniformity in thickness of a nickel plated layer, and it is possible to further improve corrosion resistance. It is inferred that this is because phosphorus atoms and/or boron atoms in the plating bath exhibit a behavior the same as the behavior of carbon atoms described in (A) to (D) of FIG. 4.

When phosphorus atoms or boron atoms are contained in a plating bath too, in the same way as carbon atoms, phosphorus atoms or boron atoms corresponding to the carbon atom content remains in a nickel plated layer to be formed. The inventors of the invention have found that it is when the concentration of phosphorus atoms or boron atoms contained in a nickel plated layer is 1.0% or more that the uniformity in thickness of the nickel plated layer is particularly promoted.

Also, the inventors of the invention have found that it is preferable that the concentration of phosphorus atoms or boron atoms contained in a nickel plated layer is 10.0% or less in order that a decrease in corrosion resistance of the nickel plated layer is suppressed. The phosphorus atom and boron atom concentrations in the nickel plated layer are values measured by the XPS in the position at the depth at which the nickel atom concentration is 80% or more, in the same way as the heretofore described carbon atom concentration.

When phosphorus atoms and boron atoms are mixed in a nickel plated layer, the uniformity in thickness of the nickel plated layer is promoted when the sum of the phosphorus atom and boron atom concentrations is 1.0% or more. Also, a decrease in corrosion resistance is suppressed when the sum of the phosphorus atom and boron atom concentrations is 10.0% or less.

Herein, it is possible to add phosphorus atoms to a plating bath by adding a phosphorus compound, such as sodium hypophosphite ($NaH_2PO_2.H_2O$), to the plating bath. It is preferable that the amount of sodium hypophosphite added to the plating bath is, for example, 0.1 g/L or more and 60 g/L or less. Also, it is possible to add boron atoms to a plating bath by adding a boron compound, such as dimethyl amine borane (DMAB), to the plating bath. It is preferable that the amount of dimethyl amine borane added to the plating bath is, for example, 0.05 g/L or more and 8 g/L or less.

II. Regarding Thickness of Nickel Plated Layer:

Even when carbon atoms and the like are contained in a plating bath in the way heretofore described, there is a possibility that a nickel plated layer small in thickness compared with in the other region is formed in a region, such as the inner wall surface of the cylindrical hole 1*ch* of the base material 1*a*, through which it is difficult for an electric current to flow. That is, when carbon atoms and the like are contained in the plating bath, it is possible to promote the local uniformity in thickness of a nickel plated layer in each region of the metal shell 1, but for the whole of the metal shell 1, there is a possibility that the thickness of the nickel plated layer varies from region to region.

However, even when the base material 1*a* has the region in which is formed that kind of nickel plated layer small in thickness, it is possible to secure the corrosion resistance of the nickel plated layer in the event that the minimum value of the thickness of the nickel plated layer is within the following range. That is, when only a nickel plated layer is formed on the surface of the metal shell 1 as a protective surface film, it is possible to suppress a decrease in corrosion resistance of the nickel plated layer in the event that the minimum value of the thickness of the nickel plated layer is 0.3 μm or more and 2.0 μm or less. This is for the following reasons.

That is, when the minimum value of the thickness of the nickel plated layer is less than 0.3 μm, many regions of the nickel plated layer lacking in thickness exist on the metal shell 1, thus increasing the likelihood that no corrosion resistance is secured. Meanwhile, when the minimum value of the thickness of the nickel plated layer is more than 2.0 μm, it increases the likelihood that many regions in which the thickness of the nickel plated layer is excessively large exist. When the thickness of the nickel plated layer is excessively large, a crack is likely to occur in the superficial layer of the nickel plated layer, and corrosion resistance decreases. In this way, in the event that the minimum value of the thickness of a nickel plated layer is within the heretofore described preferred range, it is possible to suppress an occurrence of a region of the base material 1*a* in which the thickness of the nickel plated layer is excessively small or excessively large, and a decrease in corrosion resistance is suppressed.

Also, in general, it is sufficient that a nickel plated layer on the metal shell 1 is formed to a thickness of 15.0 μm or less. However, it is preferable that the difference between the maximum value and minimum value of the thickness of the nickel plated layer is of a value of 5.5 μm or less when the minimum value of the thickness of the nickel plated layer is within the heretofore described range. That is, it is preferable that the thickness of the nickel plated layer is such that the difference between the maximum value and minimum value thereof is 5.5 μm or less. This is because when the difference between the maximum value and minimum value of the thickness of the nickel plated layer is more than 5.5 82 m, variation in thickness of the nickel plated layer on the metal shell 1 is excessively great, thus increasing the likelihood that a peeling off of the nickel plated layer occurs in the crimping step.

In this way, by adjusting the thickness of a nickel plated layer to be formed, it is possible to more reliably suppress a decrease in corrosion resistance of the nickel plated layer. The thickness of the nickel plated layer can be adjusted by adjusting the current density and treating time of the heretofore mentioned electrolytic nickel plating treatment conditions.

Meanwhile, when a protective surface film is formed on a nickel plated layer by an electrolytic chromate treatment, to be described hereafter, or a rust prevention oil coating treatment, the resistance of the nickel plated layer is improved. Because of this, the preferred range of the minimum value of the thickness of the nickel plated layer is expanded as follows. (a) When a protective surface film is formed in the double-layered structure of a nickel plated layer and chromate layer, the preferred range of the minimum value of the thickness of the nickel plated layer is 0.2 μm or more and 2.3 μm or less. (b) When a protective surface film is formed in the double-layered structure of a nickel plated layer and rust prevention oil coated layer, the preferred range of the minimum value of the thickness of the nickel plated layer is 0.2 μm or more and 2.3 μm or less. (c) When a protective surface film is formed in the triple-layered structure of a nickel plated layer, chromate layer, and rust prevention oil coated layer, the preferred range of the minimum value of the thickness of the nickel plated layer is 0.1 μm or more and 2.5 μm or less.

C. Electrolytic Chromate Treatment (Step T120 of FIG. 3):

The electrolytic chromate treatment is a treatment of forming a chromate layer on a nickel plated layer in order to protect the nickel plated layer against corrosion. A rotating barrel can be utilized in the electrolytic chromate treatment too, but another plating method, such as a still plating method, may be utilized. The electrolytic chromate treatment may be omitted, and the chromate layer on the nickel plated layer may be omitted. Examples of preferable electrolytic chromate treatment conditions are as follows.

Examples of Electrolytic Chromate Treatment Conditions

Treatment bath (chromate treatment liquid) compositions:

Sodium bichromate: 20 to 70 g/L

Solvent: deionized water

Bath pH: 2 to 6

Treatment temperature (bath temperature): 20 to 60° C.

Cathode current density: 0.02 to 0.45 A/dm$^2$

Treating time: 1 to 10 minutes

Apart from sodium bichromate, potassium bichromate can also be utilized as bichromate. Also, it is possible, in accordance with a desirable chromate layer thickness, to employee a combination of the other treatment conditions (the amount of bichromate, cathode current density, treating time, and the like) differing from the heretofore mentioned combination.

D. Rust Prevention Oil Coating Treatment (Step T130 of FIG. 3)

The rust prevention oil coating treatment is a treatment that applies rust prevention oil to the chromate layer or a nickel plated layer when the chromate layer is omitted. As rust prevention oil, it is possible to use rust prevention oil in which is contained at least one kind of carbon, barium (Ba), calcium, sodium, or the like. The rust prevention oil coating treatment may be omitted.

As a result of these corrosion protection treatments, at least a nickel plated layer is formed as a protective surface film on the outer surface of the base material 1*a* of the metal shell 1, and a chromate layer and/or an rust prevention oil coated layer is formed on the nickel plated layer, as necessary. Hereafter, in the description, a metal shell 1 on which only a nickel plated layer is formed as a protective surface film will be called a "type A", and a metal shell 1 on which two layers, a nickel plated layer and a chromate layer, are formed as a protective surface film will be called a "type B". Also, a metal shell 1 on which two layers, a nickel plated layer and an rust prevention oil coated layer, are formed as a protective surface film will be called a "type C", and a metal shell 1 on which three layers, a nickel plated layer, a chromate layer, and an rust prevention oil layer, are formed as a protective surface film will be called a "type D".

Figure 2:
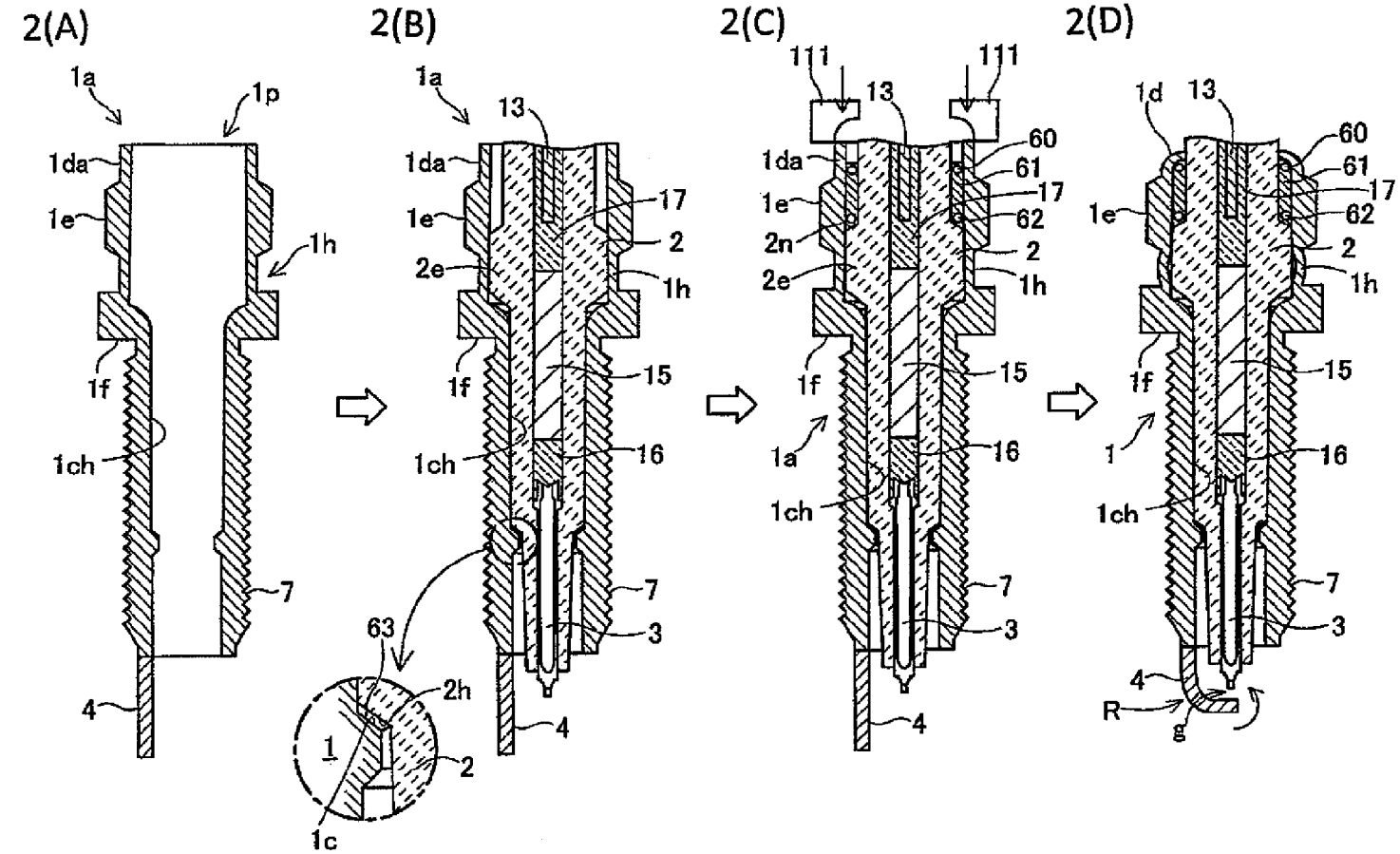
FIGS. 2A-2D illustrates showing, in order of steps, one example of a process of manufacturing a metal shell.

After these treatment steps, the spark plug 100 including the metal shell 1 is manufactured in the crimping step described in FIG. 2. Apart from cool crimping, hot crimping can also be utilized as the crimping step described in FIG. 2.

Working Examples

FIG. 6 is an illustration showing a table into which a measured value of the carbon atom concentration in a nickel plated layer and a corrosion resistance evaluation result are compiled from each of five kinds of metal shell 1 sample S01 to S05 manufactured under conditions to be mentioned hereafter. The kinds and amounts of brightening agents added to a plating bath in order to change the carbon atom concentration in the nickel plated layer on each sample S01 to S05 are shown in the table of FIG. 6.

Each metal shell 1 sample S01 and S02 is manufactured by the ground electrode 4 being joined by welding to a main body portion manufactured by cold forging using a cold heading carbon steel wire SWCH17K specified in JISG3507 as a material. After degreasing and water washing have been carried out on each sample S01 to S05, a nickel strike plating treatment using a rotating barrel is carried out on each sample S01 to S05 under the following plating treatment conditions.

Nickel Strike Plating Treatment Conditions

Plating Bath Compositions

Nickel chloride: 300±50 g/L

35% hydrochloric acid: 100±10 ml/L

Treatment temperature (bath temperature): 30±5° C.

Cathode current density: 0.33 A/dm$^2$

Treating time: 15 minutes

Further, after the nickel strike plating treatment, an electrolytic nickel plating treatment using a rotating barrel is carried out under the following treatment conditions, thereby forming a nickel plated layer on each sample S01 to S05.

Electrolytic Nickel Plating Treatment Conditions

Plating Bath Compositions

Nickel sulfate: 250±20 g/L

Nickel chloride: 50±10 g/L

Boric acid: 40±10 g/L

Brightening agent:(refer to the following)

Bath pH: 3.7±0.5

Treatment temperature (bath temperature): 55±5° C.

Cathode current density: 0.33 A/dm$^2$

Treating time: 60 minutes

Herein, with the sample S01, no brightening agent is added to the plating bath. Also, with each of the other samples S02 to S05, saccharin is used as the primary brightening agent, and 2-butyne-1,4-diol is used as the secondary brightening agent. Specifically, 0.1 g/L, 0.4 g/L, 0.8 g/L, and 1.6 g/L of saccharin are added, and 0.4 g/L, 0.5 g/L, 0.6 g/L, and 0.8 g/L of 2-butyne-1,4-diol are added to the respective plating baths for the samples S02 to S05.

With each nickel plated layer formed under the heretofore described conditions, the carbon atom concentration at a depth at which the nickel atom concentration is 80% is measured using the XPS. The atomic concentrations in the samples S01 to S05 are 0.0%, 1.0%, 5.0%, 10.0%, and 20.0% respectively.

A corrosion resistance evaluation is carried out by a neutral salt spray test in accordance with JIS H 8502. Specifically, with a testing time set to 48 hours, and one optional surface of the hexagon portion 1*e* (FIG. 1) of the metal shell 1 and the inner wall surface of the cylindrical hole 1*ch* as regions to be measured, the area of a region in which red rust occurs after a liquid medicine has been sprayed on the regions to be measured is measured. The area of the region in which red rust has occurred is measured by detecting a color change using an optical sensor.

In the description, the corrosion resistance evaluation in the neutral salt spray test is such that "◇" is shown as a highest evaluation when no red rust has occurred. "○" is shown as a second highest evaluation when the area of the region in which red rust has occurred is 5% or less of the total area of the regions to be measured, and "●" is shown as a third highest evaluation when the area of the region in which red rust has occurred is more than 5% and 10% or less. Also, "X" is shown as an undesirable evaluation when the area of the region in which red rust has occurred is more than 10% of the total area of the regions to be measured.

As shown in the table of FIG. 6, with each sample S02 to S04, the carbon atom concentration in the nickel plated layer on which is within a range of 1.0% to 10.0%, it is possible to obtain a good corrosion resistance evaluation. Also, with each sample S01 and S05, the carbon atom concentration in the nickel plated layer on which is out of the heretofore mentioned range, it is possible to obtain no preferable evaluation. In this way, in the electrolytic nickel plating treatment, by causing carbon atoms to be contained in the plating bath so that the carbon atoms are dispersed, over a nickel plated layer to be formed, at an atomic concentration within a range of 1.0% to 10.0%, it is possible to improve the corrosion resistance of the nickel plated layer.

FIG. 7 is an illustration showing a table into which a measured value of the phosphorus atom and boron atom concentrations in a nickel plated layer and a corrosion resistance evaluation results are compiled from each of eight kinds of metal shell 1 sample S06 to S13 manufactured under conditions differing from sample to sample. The kind and amount of liquid medicine added to a plating bath for each sample S06 to S13 in order to change the phosphorus atom and boron atom concentrations in the nickel plated layer on each sample S06 to S13 are shown in the table of FIG. 7. Also, an evaluation result of the sample S03 with a carbon atom concentration of 5% and phosphorus and boron atom concentrations of 0% is also shown as a reference example in the table of FIG. 7.

Each sample S06 to S13 is manufactured under conditions the same as those for the heretofore described sample S03 with a carbon atom concentration of 5% in the nickel plated layer, except points to be described hereafter. Nickel plated layers are formed one each on the samples S06 to S09 using respective plating baths to which are added 1.0 g/L, 20.0 g/L, 40.0 g/L, and 80.0 g/L of sodium hypophosphite. Also, nickel plated layers are formed one each on the samples S10 to S13 using respective plating baths to which are added 0.1 g/L, 2.5 g/L, 5.0 g/L, and 10.0 g/L of DMAB.

With the nickel plated layer on each sample S06 to S13 formed under the heretofore described conditions, phosphorus and boron concentrations at the depth at which the nickel atom concentration is 80% are measured using the XPS. The phosphorus atom concentrations in the nickel plated layers on the sample S06 to S09 are 0.1%, 5.0%, 10.0%, and 20.0% respectively. Also, the boron atom concentrations in the nickel plated layers on the samples S10 to S13 are 0.1%, 5.0%, 10.0%, and 20.0% respectively.

A corrosion resistance evaluation is carried out by measuring the area of a region in which red rust occurs using a neutral salt spray test the same as that described in FIG. 6. However, a testing time is set to be 96 hours, and only the inner wall surface of the cylindrical hole 1*ch* of the metal shell 1 is set to be a region to be measured. Evaluation results in the table of FIG. 7 are shown by "◇", "○", "●", and "X" in accordance with criteria the same as those described in FIG. 6.

With each sample S06 to S08, of the samples S06 to S09 with phosphorus atoms contained in the respective plating baths, the phosphorus atom concentration in the nickel plated layer on which is included within a range of 0.1% to 10.0%, it is possible to obtain a particularly good evaluation result. However, with the sample S09, the phosphorus atom concentration in the nickel plated layer on which is out of the heretofore described range, it is not possible to obtain any preferable evaluation result.

Also, with each sample S10 to S12, of the samples S10 to S13 with boron atoms contained in the respective plating baths, the boron atom concentration in the nickel plated layer on which is included within a range of 0.1% to 10.0%, it is possible to obtain a particularly good evaluation result. However, with the sample S13, the boron atom concentration in the nickel plated layer on which is out of the heretofore described range, it is not possible to obtain any preferable evaluation result.

In this way, when carbon atoms are dispersed at an atomic concentration within a range of 0.1% to 10.0%, and furthermore, when phosphorus atoms or boron atoms are dispersed at an atomic concentration within a range of 0.1% to 10.0%, it is possible for a nickel plated layer to obtain a particularly good corrosion resistance. When phosphorus atoms and boron atoms are mixed into a nickel plated layer, it is possible to obtain a good corrosion resistance when the sum of the phosphorus atom concentration and boron atom concentration is within a range of 0.1% to 10.0%.

FIG. 8 is an illustration showing a table into which corrosion resistance evaluation results are compiled from samples S100 to S110, S200 to S210, S300 to S310, and S400 to S410 with nickel plated layer thickness minimum values varied from one another. In FIG. 8, a current density and treating time set in order to adjust a nickel plated layer thickness in the electrolytic nickel plating treatment are shown for each nickel plated layer thickness minimum value.

The samples S100 to S110, S200 to S210, S300 to S310, and S400 to 410 are manufactured under conditions the same as those for the heretofore described sample S03 (with a carbon atom concentration of 5%), except points to be described hereafter. The samples S100 to S110 are the metal shells 1 of the type A, on each of which only a nickel plated layer is formed as a protective surface film. The samples S200 to S210 are the metal shells 1 of the type B, on each of which two layers, a nickel plated layer and an electrolytic trivalent chromate layer, are formed as a protective surface film. The samples S300 to S310 are the metal shells 1 of the type C, on each of which two layers, a nickel plated layer, and an rust prevention oil layer, are formed as a protective surface film. The samples S400 to S410 are the metal shells 1 of the type D, on each of which three layers, a nickel plated layer, an electrolytic trivalent chromate layer, and an rust prevention oil layer, are formed as a protective surface film.

Herein, conditions for an electrolytic chromate treatment carried out in order to form the electrolytic trivalent chromate layer are as follows. The treatment conditions are common to those for the samples S200 to S210 and S400 to S410 of the types B and D.

Electrolytic Chromate Treatment Conditions

Treatment bath (chromate treatment liquid) compositions:

Sodium bichromate: 40 g/L

Solvent: deionized water

Treatment temperature (bath temperature): 35±5° C.

Cathode current density: 0.2 A/dm$^2$

Treating time: 5 minutes

The electrolytic chromate treatment is carried out using a rotating barrel.

Also, with each sample S100 to S110, S200 to S210, S300 to S310, and S400 to S410, the minimum value of the thickness of the nickel plated layer is varied within a range of 0.05 to 2.8 μm by varying the current density and treating time in the electrolytic nickel plating treatment. The thickness of the nickel plated layer is measured by a fluorescent X-ray film thickness meter (model number: SFT-3200 manufactured by SI Nano Technology Inc.).

A corrosion resistance evaluation is carried out by measuring the area of a region in which red rust occurs using a neutral salt spray test the same as that described in FIG. 6. However, a testing time is set to be 72 hours, and only the inner wall surface of the cylindrical hole 1*ch* of the metal shell 1 is set to be a region to be measured. Evaluation results in the table of FIG. 7 are shown by "◇", "○", "●", and "X" in accordance with criteria the same as those described in FIG. 6.

With each sample S103 to S107, of the samples S100 to S110 of the type A, the minimum value of the thickness of the nickel plated layer on which is 0.3 μm or more and 2.0 μm or less, it is possible to obtain a good corrosion resistance evaluation. With each sample S202 to S208, of the samples S200 to S210 of the type B, the minimum values of the thickness of the nickel plated layer on which is 0.2 μm or more and 2.3 μm or less, it is possible to obtain a good corrosion resistance evaluation. With each sample S302 to S308, of the samples S300 to S310 of the type C, the minimum value of the thickness of the nickel plated layer on which is 0.2 μm or more and 2.3 μm or less, it is possible to obtain a good corrosion resistance evaluation.

With each sample S401 to S409, of the samples S400 to S410 of the type D, the minimum value of the thickness of the nickel plated layer on which is 0.1 μm or more and 2.5 μm or less, it is possible to obtain a good corrosion resistance evaluation. Also, with each sample S404 to S409, of the samples S400 to S410 of the type D, the minimum value of the thickness of the nickel plated layer on which is 0.3 μm or more and 1.5 μm or less, it is possible to obtain a particularly good corrosion resistance evaluation. In this way, when the minimum value of the thickness of a nickel plated layer is within the heretofore described preferred range, it is possible to obtain a good corrosion resistance evaluation.

FIG. 9 is an illustration showing a table into which a difference between the maximum value and minimum value of the thickness of a nickel plated layer and a corrosion resistance evaluation result are compiled from each sample S100 to S110, S200 to S210, S300 to S310, and S400 to S410. A current density and treating time set in order to adjust a nickel plated layer thickness in an electrolytic nickel plating treatment in the same way as in FIG. 8 are shown in FIG. 9.

A corrosion resistance evaluation is carried out by measuring the area of a region in which red rust occurs using a neutral salt spray test the same as that described in FIG. 6. However, a testing time is set to be 96 hours, and one optical surface of the hexagon portion 1*e* (FIG. 1) of the metal shell 1 and the inner wall surface of the cylindrical hole 1*ch* are set to be regions to be measured. Evaluation results in the table of FIG. 9 are shown by "◇", "○", "●", and "X" in accordance with criteria the same as those described in FIG. 6.

With each sample S100 to S107, of the samples S100 to S110 of the type A, the difference between the maximum value and minimum value of the thickness of the nickel plated layer on which is 5.5 μm or less, it is possible to obtain a good corrosion resistance evaluation. With each sample S200 to S208, of the samples S200 to S210 of the type B, the difference between the maximum value and minimum value of the thickness of the nickel plated layer on which is 6.0 μm or less, it is possible to obtain a good corrosion resistance evaluation. With each sample S300 to S308, of the samples S300 to S310 of the type C, the difference between the maximum value and minimum value of the thickness of the nickel plated layer on which is 6.0 μm or less, it is possible to obtain a good corrosion resistance evaluation.

With each sample S400 to S409, of the samples S400 to S410 of the type D, the difference between the maximum value and minimum value of the thickness of the nickel plated layer on which is 6.5 μm or less, it is possible to obtain a good corrosion resistance evaluation. Also, with each sample S404 to S408, of the samples S400 to S410 of the type D, the difference between the maximum value and minimum value of the thickness of the nickel plated layer on which is 4.0 μm or more and 6.0 μm or less, it is possible to obtain a particularly good corrosion resistance evaluation.

In this way, when the minimum value of the thickness of a nickel plated layer is within the preferred range, it is possible to obtain a better corrosion resistance evaluation when the difference between the maximum value and minimum value of the thickness of the nickel plated layer is of a predetermined value or lower. Herein, no evaluation result when the difference between the maximum value and minimum value of the thickness of the nickel plated layer is 1.5 μm or less is shown in FIG. 8. However, when the difference between the maximum value and minimum value of the thickness of the nickel plated layer is 1.5 μm or less, it is possible to obtain a high corrosion resistance because the non-uniformity in thickness of individual regions of the nickel plated layer is extremely low.

Reference Signs List

1 . . . Metal shell
1*a* . . . Base material
1*ch* . . . Cylindrical hole
1*d* . . . Crimped portion
1*da* . . . Portion to be crimped
1*e* . . . Hexagon portion
1*f* . . . Gas seal portion
1*h* . . . Thin-walled portion (groove portion)
1*p* . . . Insertion opening portion
2 . . . Insulator
2*e* . . . Protruding portion
2*h*, 1*c* . . . Engagement portion
2*n* . . . End surface
3 . . . Center electrode
4 . . . Ground electrode
6 . . . Through hole
7 . . . Thread portion
13 . . . Terminal metal fixture
15 . . . Resistor
16, 17 . . . Conductive glass seal layer
30 . . . Gasket
60 . . . Wire packing
61 . . . Filling layer
62 . . . Wire packing
63 . . . Plate packing
100 . . . Spark plug
111 . . . Die
C . . . Carbon atom
Ni . . . Nickel atom
R . . . Bend portion
g . . . Spark discharge gap Having described the invention, the following is claimed:

1. A spark plug including a metal shell whose outer surface is coated with a nickel plated layer, characterized in that the nickel plated layer is such that when the atomic concentrations of constituent elements are measured in a depth direction by an X-ray photoelectron spectroscopy (XPS), the atomic concentration of C elements is 1.0% to 10.0% at a depth at which the atomic concentration of Ni elements is 80%.

2. The spark plug according to claim 1, wherein the nickel plated layer is such that the minimum value of the thickness is 0.3 μm or more and 2.0 μm or less, and the maximum value of the thickness is 15 μm or less.

3. The spark plug according to claim 2, wherein the nickel plated layer is such that the difference between the maximum value of the thickness and the minimum value of the thickness is 5.5 μm or less.

4. The spark plug according to claim 1, wherein a chromate layer or an rust prevention oil layer is formed on the nickel plated layer, and the nickel plated layer is such that the minimum value of the thickness is 0.2 82 m or more and 2.3 μm or less, and the maximum value of the thickness is 15 μm or less.

5. The spark plug according to claim 4, wherein the nickel plated layer is such that the difference between the maximum value of the thickness and the minimum value of the thickness is 6.0 μm or less.

6. The spark plug according to claim 1, wherein a chromate layer is formed on the nickel plated layer, and an rust prevention oil layer is formed on the chromate layer, wherein the nickel plated layer is such that the minimum value of the thickness is 0.1 μm or more and 2.5 μm or less, and the maximum value of the thickness is 15 μm or less.

7. The spark plug according to claim 6, wherein the nickel plated layer is such that the difference between the maximum value of the thickness and the minimum value of the thickness is 6.5 μm or less.

8. The spark plug according to claim 1, wherein the nickel plated layer is such that when the atomic concentrations of constituent elements are measured in the depth direction by the X-ray photoelectron spectroscopy (XPS), the sum of the atomic concentration of P elements and the atomic concentration of B elements is 1.0% to 10% at the depth at which the atomic concentration of Ni elements is 80%.

* * * * *